United States Patent [19]

Melink

[11] Patent Number: 4,903,685

[45] Date of Patent: Feb. 27, 1990

[54] VARIABLE EXHAUST CONTROLLER FOR COMMERCIAL KITCHENS

[76] Inventor: Stephen K. Melink, 6558 Miami Ave., Cincinnati, Ohio 45243

[21] Appl. No.: 301,538

[22] Filed: Jan. 24, 1989

[51] Int. Cl.[4] ..... F23J 11/02

[52] U.S. Cl. ..... 126/299 D

[58] Field of Search ..... 98/115.1, 115.2, 115.3; 126/299 R, 299 D

[56] References Cited

U.S. PATENT DOCUMENTS

| | | | |
|---|---|---|---|
| 3,625,135 | 12/1971 | Carlson | 126/299 D |
| 3,690,245 | 9/1972 | Ferlise et al. | 126/299 D |
| 3,691,931 | 9/1972 | Persson | 126/299 D |
| 3,800,689 | 4/1974 | Brown | 126/299 D |
| 3,826,180 | 7/1974 | Hayashi | 98/42.03 |
| 3,932,137 | 1/1976 | Culpepper, Jr. | 126/299 D X |
| 4,105,015 | 8/1978 | Isom | 126/299 D |
| 4,121,199 | 10/1978 | Young | 126/299 D X |
| 4,166,448 | 9/1979 | Miller et al. | 126/299 D |
| 4,372,195 | 2/1983 | Dorius | 126/299 R |
| 4,386,733 | 6/1983 | Bradshaw | 126/299 C X |
| 4,437,608 | 3/1984 | Smith | 236/13 |
| 4,741,257 | 5/1988 | Wiggin et al. | 98/115.3 |
| 4,822,385 | 4/1989 | Strege et al. | 126/299 D X |

FOREIGN PATENT DOCUMENTS

| | | | |
|---|---|---|---|
| 2747710 | 4/1979 | Fed. Rep. of Germany . | |
| 2518750 | 6/1979 | Fed. Rep. of Germany . | |
| 75146 | 6/1980 | Japan | 126/299 D |
| 60-14027 | 1/1985 | Japan | 126/299 D |
| 2002106 | 2/1979 | United Kingdom | 126/299 D |

*Primary Examiner*—Harold Joyce

*Attorney, Agent, or Firm*—Wood, Herron & Evans

[57] ABSTRACT

An energy saving controller for kitchen exhaust systems is disclosed in which the exhaust fan speed is varied in proportion to the level of cooking by-product seeking to escape from a flow path within the exhaust hood. The exhaust fan speed may also be varied in relation to the heat load of the cooking units as indicated by temperature above the units or energy consumed thereby. Further, where make-up air is provided, the speed of the make-up air fan may be similarly varied.

42 Claims, 2 Drawing Sheets

VARIABLE EXHAUST CONTROLLER FOR COMMERCIAL KITCHENS

BACKGROUND OF THE INVENTION

I. Field of the Invention

The present invention relates to commercial and institutional kitchen exhaust systems, and more particularly, to an energy conserving exhaust rate control method and apparatus for exhaust systems for such kitchens.

II. Description of the Prior Art

Commercial and institutional kitchens are equipped to prepare food for large numbers of people and may form part of or adjoin larger facilities such as restaurants, hospitals and the like. Such kitchens are typically equipped with one or more commercial duty cooking units capable of cooking large amounts of food. On such a scale, the cooking process may generate substantial amounts of heat and air-borne cooking by-products such as water vapor, grease particulates, smoke and aerosols, all of which must be exhausted from the kitchen so as not to foul the environment of the facility. To this end, large exhaust hoods are usually provided over the cooking units, with duct work connecting the hood to a motor driven exhaust fan located outside the facility such as on the roof or on the outside of an external wall. As the fan is rotated by the motor, air within the kitchen is drawn into the hood and exhausted to the outside atmosphere. In this way, heat and cooking by-products generated by the cooking units follow a flow path from the cooking units into the hood towards the duct so that they may be liminated from the kitchen before they escape into the kitchen environment and perhaps into the rest of the facility.

As is conventional, the motor driving the exhaust fan rotates at a fixed speed. The exhaust fan thus rotates at a fixed speed as well and, therefore, tends to draw a constant volume of air through the hood. However, the amount of heat and/or cooking by-products generated by the cooking units will vary widely over the course of the day. If the selected fan speed is too low, during peak cooking periods, the fan will underexhaust allowing heat and/or cooking by-products to escape from the hood and into the kitchen and, perhaps, the rest of the facility. Accordingly, it has been the practice to select a speed for the fan that will exhaust the heat and cooking by-products generated during anticipated peak usage of the cooking units. It if often the case, however, that peak generation of heat and cooking by-products only infrequently occurs. Under these conditions, the exhaust fan continues to draw a volume of air intended to pull maximum heat and cooking by-product from the kitchen even though it is unnecessary to draw that large a volume of air. This condition, known as overexhausting, is very energy inefficient. For example, if the exhaust fan motor is running continuously at a high speed, much of the time the motor is consuming energy unnecessarily. Similarly, the life of the exhaust fan motor may be shortened as a result.

Overexhausting also poses a source of substantial energy waste in connection with the heating, ventilation and air conditioning (HVAC) which is utilized to condition the air in the kitchen and/or the rest of the facility. Usually, the entire facility including the kitchen must be maintained with a humanly acceptable and comfortable internal atmospheric environment. This is normally accomplished with one or more HVAC systems to provide conditioned air which is heated or cooled, humidified or dehumidified, and/or recirculated or replenished with fresh air in accordance with the demands of the seasons and the use of the facility. Such HVAC systems consume large amounts of energy and contribute substantially to the cost of the facility's overall operating budget. Unfortunately, substantial volumes of conditioned air pass out of the facility through the kitchen exhaust along with the heat and cooking by-products generated by the kitchen cooking units. As a consequence, the HVAC must make up for the lost volume of conditioned air by conditioning more air, thus resulting in consumption of more energy by and further loading of the HVAC system.

A still further drawback to overexhausting is the negative pressure created by the exhaust fan. Such negative pressure created in the kitchen tends to draw air from the rest of the facility into the kitchen setting up a draft in the facility. Some conventional kitchen exhaust systems include make-up air fans which provide outside air into the kitchen in the environment of the hood in an effort to balance pressure between the kitchen and the rest of the facility. Provision for make-up air also helps to reduce the amount of conditioned air which is lost to the kitchen exhaust system. However, make-up air fans do not entirely eliminate the problems associated with constant volume exhaust.

It has been suggested to vary the speed of an exhaust fan in proportion to the temperature of the air above the cooking units. While such an approach may reduce energy waste, it is not believed to be sufficient to ensure that all cooking by-products are removed, especially when large levels of cooking by-product are being generated while the cooking units are at a low heat condition. Thus, overexhausting may be reduced somewhat but with the risk of allowing cooking by-product to escape from the hood and into the kitchen. Escaping cooking by-product is to be strictly avoided.

It has also been suggested to vary the speed of the exhaust fan in accordance with the level of cooking by-product in the flow path. While this may reduce risk of underexhausting and may even help to minimize occasions of overexhausting, other drawbacks may present themselves. In particular, the sensors used to monitor for the by-product in the flow path are to be placed directly into the flow path of the by-products, which may permit grease, for example, to accumulate on the sensor risking damage thereto. In particular, such systems are not believed to be very effective in that the sensor may become coated or clogged with grease or other cooking by-products which may alter the ability of the sensor to accurately sense and respond correctly to the level of cooking by-products. Under these circumstances, the exhaust fan may be erroneously caused to operate at the wrong speed resulting in over- or underexhausting.

SUMMARY OF THE INVENTION

The present invention overcomes the drawbacks encountered in the prior art. More specifically, and in accordance with one aspect of the present invention, the cooking load of the cooking units is determined by monitoring the level of cooking by-products generated which try to escape out of the normal flow path, rather than the density of such by-products in the flow path. Thus, a by-product sensor may be utilized which is placed outside the normal flow path of the cooking by-products and preferably along an edge of the exhaust system hood. Detection of by-product at the edge of the hood is indicative of under-exhausting which, if not corrected, would allow by-product to escape the normal flow path. In response to such detection, the volume rate of air being exhausted is increased such as by increasing exhaust fan speed accordingly. The present invention thus reduces the likelihood that cooking by-products will interfere with proper functioning of the by-product sensor so that proper volume rate of air exhaust may be expected over the useful life of the kitchen exhaust system. Thus, for example, the exhaust fan may be set to a normally lower and more energy efficient speed for nominal operation than is currently the case, and the speed increased when necessary to prevent underexhausting.

In accordance with a further aspect of the present invention, the volume rate of air exhausted is further varied in proportion to the heat load of the cooking units, such as the heat generated thereby. For example, convection heat load is created by the heating of air in the kitchen by the hot cooking surfaces of the units. Combustion heat load may also be created where gas cooking units are used. These heat loads may be sensed by a temperature sensor placed at or above the cooking units. Alternatively, the heat load may be sensed by an energy sensor which monitors the amount of energy consumed by the cooking units, which amount is proportional to the heat load generated by these units. By varying the volume rate of air exhaust in proportion to both the cooking load and heat load, the volume rate of air exhausted will be geared to the actual usage of the cooking units and in a manner to avoid both under- and overexhausting. Accordingly, the lifetime of the exhaust fan and HVAC may be extended, and the energy consumed thereby kept to a minimum without sacrificing exhaust system performance.

Preferably, the by-product sensor is optical with an infrared light source and photoelectric detector positioned exteriorly of the hood. The source launches an infrared light beam into and across the hood out of the normal flow path for detection by a photoelectric detector. The level of light detected by the detector is indicative of the level or density of cooking by-product passing through the light beam and which is escaping from the normal flow path. The sensor mechanism is thus safely out of the normal flow path and thus not likely to be adversely affected by cooking by-product. Further preferably, the speed of the exhaust is increased or decreased in proportion to the weighted sum of the sensed heat load and cooking load (within the limits of the motor driving the fan) to thereby vary the volume rate of exhausted air.

The principles of the present invention may also be applied to an exhaust system including an air make-up fan. Thus, in accordance with a yet further aspect of the present invention, the speed of the make-up air fan may itself be controlled in proportion to the cooking load and/or the heat load. Thus, for example, the speed of the make-up air fan may be varied along with the speed of the exhaust fan so that the two track together. Alternatively, the exhaust fan speed may be maintained at a constant speed as with a conventional kitchen exhaust system, but the speed of make-up air fan varied in inverse proportion to the cooking and heat loads. While this alternative results in a constant volume rate of air exhausted by the exhaust fan, variation of the make-up air fan speed in accordance with the present invention provides an effective reduction in the amount of conditioned air unnecessarily exhausted.

As a result of the present invention, advantages are provided by which the volume rate of exhaust air s maintained at a level which is effective to exhaust the varying levels of cooking by-product and heat produced throughout the course of the day, while exhausting no more than the minimum amount of conditioned air from the facility and without risk of over or under exhausting due to adverse impact on the by-product sensor. Thus, not only is the energy consumption of the exhaust system held to a minimum, but a substantial overall savings in energy by the HVAC system of the facility is realized. In addition, comfort in the facility is increased and noise from the exhaust system fan is reduced. Still further, where the volume rate of exhaust air is varied, less air will pass over the cooking units during non-peak periods resulting in reduced convection heat losses and less cycling of the cooking units to maintain the selected cooking temperature, as well as a concomitant reduction of negative pressure situations with their attendant drawbacks. As well, strain on the motors of the exhaust and HVAC systems is reduced leading to longer life of those systems. The present invention provides not only a kitchen exhaust system for new construction but may also be readily adapted to existing kitchen exhaust systems.

These and other objectives and advantages of the present invention shall be made apparent from the accompanying drawings and the description thereof.

BRIEF DESCRIPTION OF THE DRAWINGS

The accompanying drawings, which are incorporated and constitute a part of this specification, illustrate embodiments of the invention and, together with the general description given above and the detailed description of the embodiments given below, serve to explain the principles of the present invention.

DETAILED DESCRIPTION OF THE DRAWINGS

Figure 1:
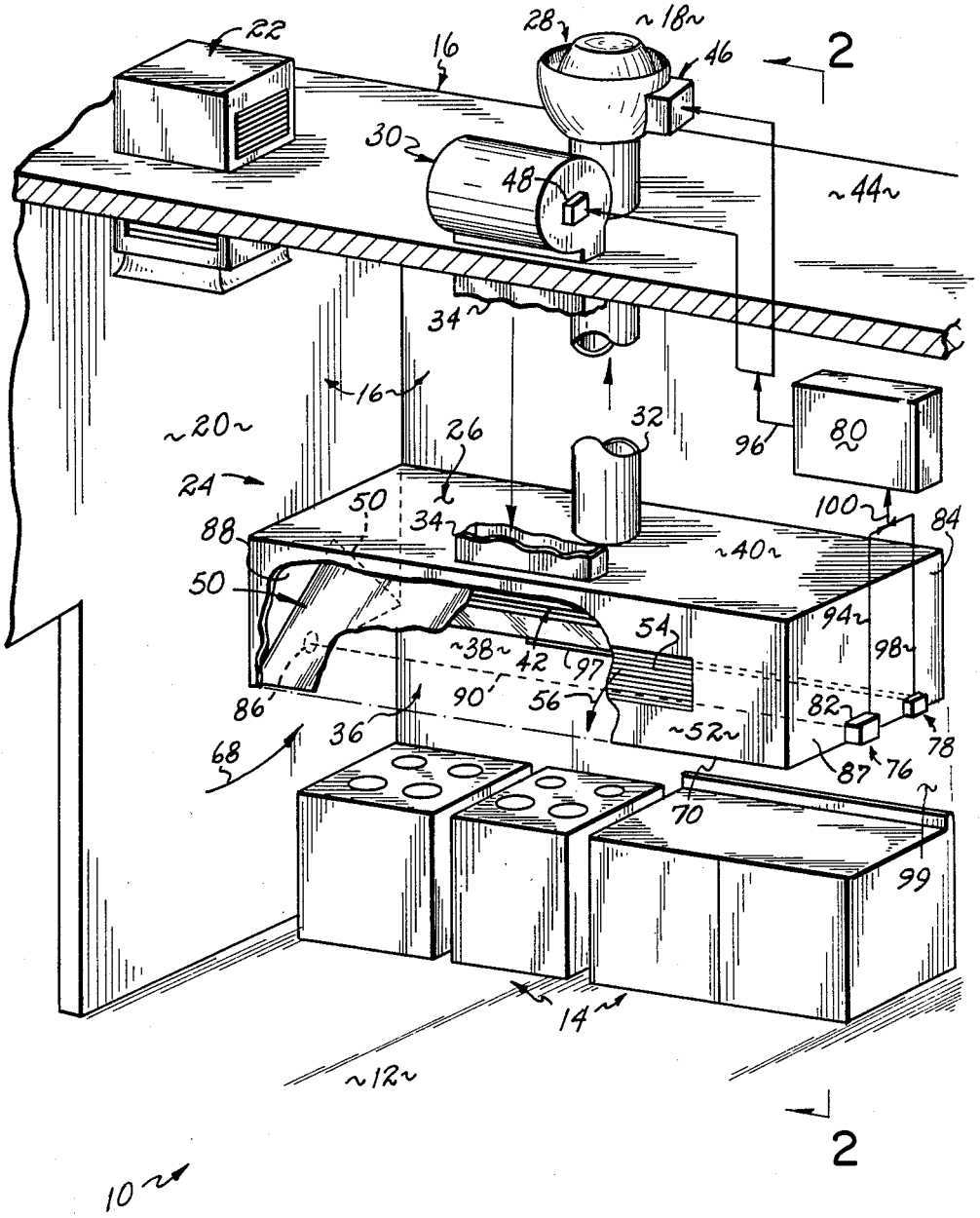
FIG. 1 is a prospective view diagrammatically illustrating a restaurant or institutional facility, primarily the kitchen area and cooking units thereof, and including a kitchen exhaust system according to principles of the present invention.

Referring to FIG. 1, a restaurant or institutional facility 10 is shown having a kitchen 12 in which is situated a plurality of commercial cooking units 14 such as one or more stoves, ovens, griddles and the like. The facility 10 is surrounded by an enclosure 16 (such as a roof and walls) which separates the outside environment 18 from the inside environment 20 of facility 10 including kitchen 12. Facility 10 is also equipped with a heating, ventilating and air conditioning system ("HVAC") 22 which maintains the inside environment 20 at a suitable condition for the use of the occupants of facility 10.

Situated over the cooking units 14 in kitchen 12 is an exhaust system 24 including an exhaust hood 26 communicating with exhaust assembly 28 and make-up air assembly 30 through respective ducts 32, 34. Hood 26 may be generally rectangular as shown with a downwardly facing opening 36 overlying cooking units 14 and communicating with the internal volume 38 of hood 26. Exhaust duct 32 is connected through top wall 40 of hood 26 for communication between volume 38 and exhaust assembly 28 through a filter assembly 42 as is well understood. To this end, exhaust duct 32 extends upwardly through the roof 44 of enclosure 16 and terminates in exhaust assembly 28 by which to exhaust air from volume 38 to the outside environment 18. Exhaust assembly 28 may include a motor 46 coupled to a fan (not shown) as is well understood. Make-up air assembly 30 may also include a motor 48 driving a fan (not shown) as is well understood.

Outlet duct 34 may be provided between top wall 40 of hood 26 and make-up assembly 30 on roof 44 by which to drive make-up air from the outside environment 18 into environment 20 adjacent hood 26. To this end, hood 26 may include a baffle or partition 50 within volume 38 to direct make-up air towards front wall 52 of hood 26. The make-up air then passes out of hood 26 through vent 54 in front wall 52 as indicated by arrow 56 in FIG. 2. Hood 26 might alternatively be a low profile hood and/or with no provision for make-up air as is well understood.

Figure 2:
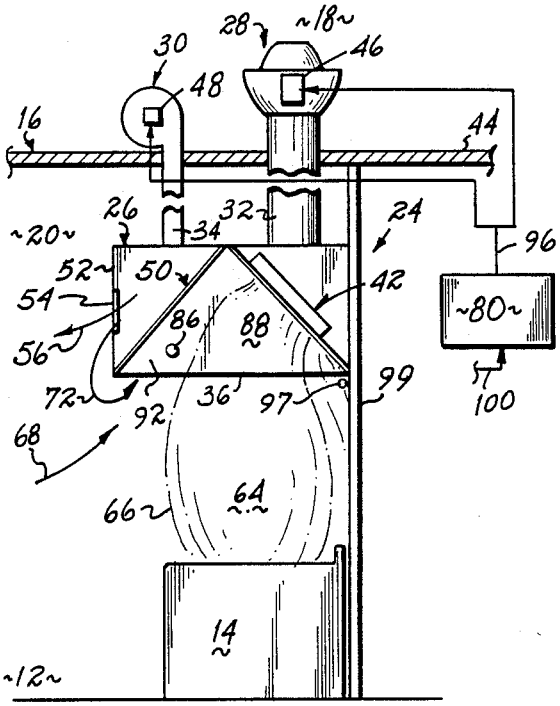
FIG. 2 is a cross-sectional view taken along line 2—2 of FIG. 1 showing the normal flow path in a kitchen exhaust system operating in accordance with the principles of the present invention.
Figure 3:
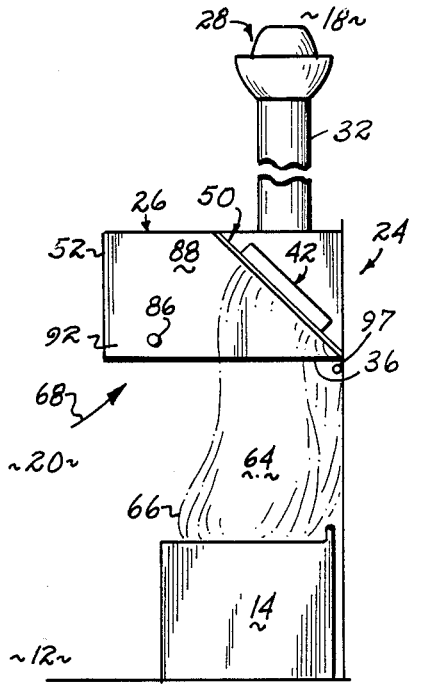
FIG. 3 is a drawing similar in format to FIG. 2, illustrating a kitchen exhaust system operating in accordance with the principles of the present invention but in context of an exhaust system having no make-up air fan.

As may be seen in FIGS. 2 and 3, when the volume rate of air being exhausted is at a level approximately equal to the heat load and cooking load of cooking units 14, a normal flow path 64 is defined between cooking units 14 and exhaust duct 32. All of the cooking by-product is supposed to be contained with flow path 64, the peripheral edges 66 of which are spaced from the walls such as front wall 52 of hood 26. Also, exhaust system 24 draws some air from environment 20 into hood 26 as represented by arrow 68 to carry away the heat and cooking by-products generated by cooking units 14. Air 68 is typically air that has been conditioned by HVAC 22. Where provision is made for make-up air, that air may pass into environment 20 and then be drawn around lower edge 70 of front wall 52 where it is drawn into hood 26 as represented by arrow 72. Make-up air 72 may result in a reduction of the volume of conditioned air 68 otherwise drawn from environment 20.

Figure 4:
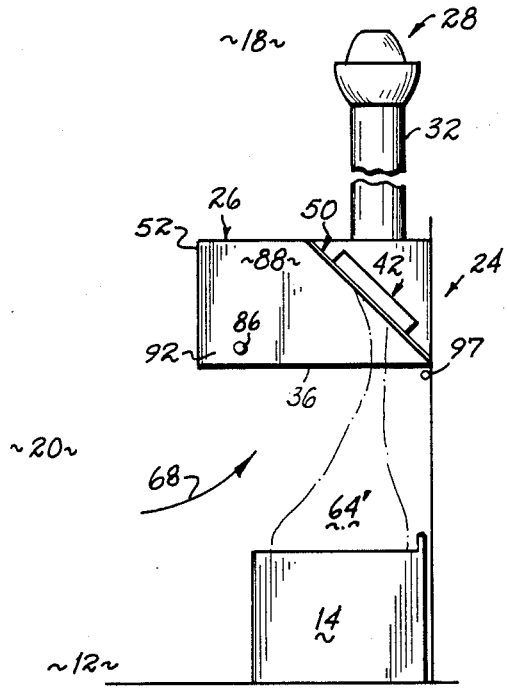
FIG. 4 is a view similar in format to FIG. 3 but illustrating the exhaust system operating at an excessive air exhaust rate overexhausting air including excessive conditioned air from the kitchen.
Figure 5:
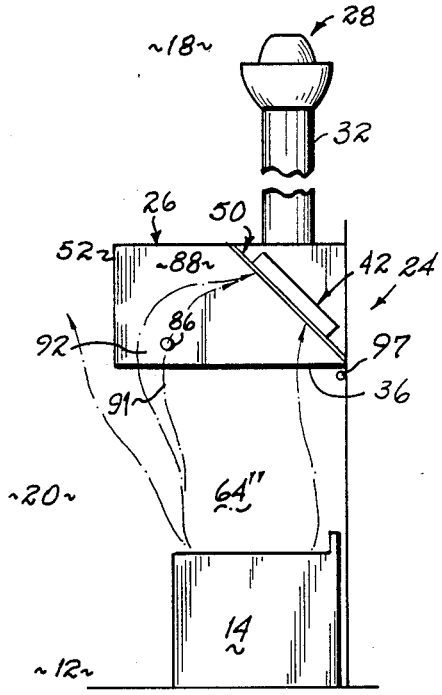
FIG. 5 is a drawing similar in format to FIG. 4 but illustrating a cooking unit with an exhaust system operating at insufficient exhaust rate whereby cooking by-product is escaping into the kitchen environment.

In a conventional kitchen exhaust system, the normal flow path 64 depicted in FIGS. 2 and 3 will typically occur only during peak usage of cooking units 14. At other times, the system is overexhausting as seen in FIG. 4 in which the flow path 64' is compressed. Under these circumstances, more conditioned air 68 is drawn out of environment 20 than is necessary to carry away the heat and cooking by-products generated by the cooking units resulting in substantial energy waste and other problems. Similarly, if the exhaust fan speed of the conventional kitchen exhaust system is set too low, the exhaust fan will underexhaust allowing the flow path 64" to reach or pass beyond front wall 52. As a consequence, heat may build up in the kitchen and, in some cases, cooking by-products may escape from hood 26 and into environment 20 of facility 10. Such a situation as shown in FIG. 5 not only places undue load on the HVAC system, it is unacceptable for a number of apparent reasons not the least of which is the discomfort and possible risk of having smoke fill the kitchen and perhaps the rest of the facility.

The above may be a conventional kitchen exhaust system to which the present invention may be applied to advantageously control the volume rate of air exhausted by exhaust system 24 so as to eliminate heat and cooking by-products generated by cooking units 14 in an energy efficient manner. To this end, a by-product sensor 76, a heat load sensor such as a temperature sensor 78 and a control module 80 are provided to control the speed of one or both of motors 46, 48 as will now be described.

In accordance with the principles of the present invention, by-product sensor 76 is situated physically out of the normal flow path 64 so that reliability of the system is enhanced. By-product sensor 76 is preferably photoelectric and may include an emitter/detector unit 82 combining an infrared light source and photoelectric detector mounted to the exterior of side wall 84 of hood 26 and a reflector 86 mounted on opposite side wall 88 of hood 26. An exemplary by-product sensor 76 may include Type SP-564A retro-reflective L.E.D. module available from Frost Controls, Inc. of Smithfield, R.I.

The light source of unit 82 launches a beam of infrared light into hood 26 through a hole (not shown) in side wall 84 such that the beam passes through internal volume 38 along a path 90 and impinges reflector 86 for return along path 90 to the detector of unit 82. Alternatively, to avoid drilling a hole in side wall 84 unit 82 could be mounted to launch the light beam from below the edge 87 of side wall 84 but aimed at reflector 86 such that path 90 passes into and out of volume 38. Although not shown, unit 82 could be a light source and reflector 86 a light detector at opposite ends of path 90. Unit 82 and reflector 86 are preferably positioned such that light beam path 90 is generally parallel front wall 52 of hood 26 and between wall 52 and the forward edge 66 (to the left in FIG. 2) of normal flow path 64 so as to detect cooking by-product escaping from flow path 64 which is indicative of underexhausting as indicated at 91 in FIG. 5. As the cooking by-products thus escape, they will interfere with the light beam in path 90 causing the detector of unit 82 to output an analog signal approximately proportional to the density of cooking by-products escaping from normal flow path 64 and into a frontal zone 92 adjacent front wall 52 of hood 26. The output of the detector of unit 82 may vary between a minimum at which no cooking by-product is detected in zone 92 and a maximum indicative of cooking by-product escaping at a level at or above the sensitivity level of by-product sensor 76.

The analog signal from by-product sensor 76 is coupled over electrical wire 94 to control module 80. In response to changes in the level of signal on wire 94, control module 80 will vary its output signal on line 96. Line 96 is coupled to one or both of motors 46, 48 in assemblies 28, 30 to control the fan speed thereof. Preferably, the output on line 96 varies, in part, in proportion to the magnitude of the analog signal on wire 94 from by-product sensor 76. Consequently, the speed of the fans may normally be driven at relatively low speeds and the speed thereof increased as exhaust system 24 begins to underexhaust as indicated by the signal from by-product sensor 76 and decreased as the level of by-product in the frontal zone 92 decreases.

In conjunction with the signal from the by-product sensor 76, module 80 further preferably adjusts the speed of one or both motors 46, 48 in response to the heat load of cooking units 14 as well. To this end, the heat load is sensed by temperature sensor 78 positioned at or above cooking units 14 to monitor the temperature of the air thereat as a measure of the heat generated by the cooking units. Temperature sensor 78 may be a Model No. TT-242-AV temperature transmitter available from Control Products Inc., in Minneapolis, Minn. Sensor 78 is mounted to the exterior of side wall 84 with an elongated averaging probe member 97 below edge 87 of wall 84 and adjacent volume 38 below filter assembly 42. Probe member 97 may be secured to back wall 99 of hood 26. Alternatively, probe member 97 could extend through a hole in wall 84 and into volume 38. Further alternatively, sensor 78 could be mounted to exhaust duct 32 with the probe member extending into duct 32. Instead of a temperature sensor, sensor 78 could be an energy sensor (not shown) which measures the electrical and/or gas consumption of cooking units 14.

The output of sensor 78 is an analog signal which is approximately proportional to the heat load of cooking units 14. The analog signal from sensor 78 is coupled over wire 98 to control module 80. In response to change in the level of signal in wire 98, control module 80 will vary its output signal on line 96 to cause the speed of the fans to vary in proportion to the heat load of cooking units 14. Thus, for example, in the case of underexhausting, the temperature in hood 26 may rise resulting in an increased signal on wire 98 with a concomitant increase in the speed of the fans. Similarly, in the case of overexhausting, the temperature in hood 26 may drop resulting in a decreased signal on wire 98 with a concomitant decrease in the speed of the fan.

Preferably, the signals on wires 94 and 98 are combined to provide one signal to control module 80 by which to vary the speed of the fans in proportion to the combination of heat load and cooking load. In a preferred embodiment this is accomplished by merely shorting wires 94 and 98 together as at 100 to provide an overall load signal to control module 80. Alternatively, the signals on wires 94, 98 may be electrically summed such as by an amplifier or the like (not shown) as is well understood.

In one embodiment, the output of by-product sensor 76 is a current signal having a range between 3–7 milliamps, and the output of temperature sensor 78 is a current signal having a range of 4–13 milliamps, the latter corresponding to a temperature range of about 70° to 140° F. for gas cooking units 14 and 70° to 120° F. for electric cooking units 14. When combined as at 100, the two analog signals thus have a range of between 7 and 20 milliamps to provide a weighted sum having a ratio of heat load to cooking load of up to about 2:1. Thus, for example, at minimum heat and cooking load, the exhaust fan may be running at 25% rated speed. The cooking load may increase fan speed as much as another 25% and the heat load as much as another 50% until the fan is at 100% rated speed for maximum heat and cooking loads. Different weighting ratios may be obtained such as with one or more potentiometers (not shown) to vary the current level provided to control module 80 at given heat and/or cooking loads. This allows field modification or calibration to conform to the desired response most appropriate for the circumstances.

Control module 80 may be a variable frequency drive as is well known for varying motor speed in accordance with the level of an input signal. Such a drive may be a JUSPEED-F, $S_2$ series from Yaskawa Electric, Tokyo, Japan or an OEM variable speed drive available from Graham Co. in Milwaukee, Wis., for example. Preferably, the output of control module 80 is substantially continuously variable in proportion to the analog signal at 100 so as to substantially continuously vary the speed of motors 46, 48 in proportion to the sum of the density of escaping cooking by-product generated by, and the heat load of, cooking units 14. "Substantially continuous" may include discrete step changes in motor speed as long as there are sufficient steps to select an effective and not excessive exhaust rate for the various cooking and heat loads encountered. Thus, the volume rate of air exhausted by assembly 28 is varied in proportion to the cooking load of units 14 whereby the exhaust fan need not be set to run at a constant speed selected to account for maximum cooking load. Additionally, the speed of the make-up air fan may also be varied so that the volume rate of make-up air supplied is correlated to the volume rate of air exhausted to minimize oversupplying make-up air when the exhaust fan speed is reduced. Where the exhaust fan is to be run at a constant speed, overexhausting of conditioned air 68 may be reduced by varying the volume rate of make-up air in inverse proportion to at least the level of signal from by-product sensor 76, for example.

Where no provision is made for make-up air, i.e., where make-up air assembly 30 is not provided (such as depicted in FIG. 3) output line 96 from control module 80 is coupled only to motor 46 of exhaust assembly 28 to vary the volume rate of exhausted air by varying the speed of that fan. Where both assemblies 28, 30 are provided, line 96 may be coupled to either or both of motors 46, 48 of the two assemblies. Where only exhaust assembly 28 is so-controlled, assembly 30 may operate at a fixed speed or its speed may be varied to balance the pressure in facility 10 as is well understood. Where only make-up air assembly 30 is controlled by control module 80, exhaust assembly 28 may operate at a fixed speed and the volume of make-up air supplied by assembly 30 varied in accordance with the cooking and heat loads to reduce the load on the HVAC system. Preferably, where make-up air assembly 30 is provided, both of assemblies 28 and 30 are responsive to signals from control module 80 so as to vary the speed of both fans in a correlated manner.

The present invention thus provides a kitchen exhaust system which adjusts the volume rate of exhaust air to account for the heat and cooking loads actually existing so as to minimize energy consumption. With particular respect to cooking load, it is monitored by a by-product sensor physically out of the normal flow path for cooking by-product between the cooking units and the exhaust duct so as not to be harmed by the by-product itself thereby providing a long-life and reliable mechanism for varying fan speed, for example, to maintain the energy efficient advantages of the present invention. The sensors and control modules of the present invention may be included in a new construction exhaust system 24. They may also be applied to an exhaust system to retrofit same by mounting sensors 76 and 78 to the existing hood (and with appropriate holes therein if necessary) and interrupting existing power to the fan motor(s) and replacing it with power from the control module 80.

While the present invention has been illustrated by descriptive embodiments and while the illustrative embodiments have been described in considerable detail, it is not the intention of the applicant to restrict or in any way limit the scope of the appended claims to such detail. Additional advantages and modifications will readily appear to those skilled in the art. For example, temperature sensor 78 may be an infrared sensor. Further, a separate module 80 may be supplied for each assembly 28 and 30 and may even be incorporated into the respective assemblies, or sensors 76, 78 and control module 80 contained in one unit. Additionally, multiple by-product and/or heat load sensors may be utilized. Yet further, as is well understood, the density of the make-up air will change with temperature. As a consequence, at any given speed, the make-up air fan will move more air at 0° F. than at 80° F., for example. The exhaust fan speed may, thus, be further adjusted accordingly to move the greater or lesser volume of make-up air in accordance with the temperature thereof. The invention in its broader aspects is therefore not limited to the specific details, representative apparatus and method, and illustrative examples shown and described. Accordingly, departures may be made from such details without departing from the spirit or scope of applicant's general inventive concept.

What is claimed is:

1. A method of controlling the volume rate of air exhausted from a hood adjacent a cooking unit and through an exhaust passage coupled to the hood, the hood positioned to collect heat and cooking by-product generated by the cooking unit, the method comprising:

defining a flow path through the hood and between the cooking unit and the exhaust passage;

sensing outside the flow path a level of cooking by-product escaping from the flow path;

varying the volume rate at which air is exhausted through the exhaust passage in accordance with at least the sensed level of cooking by-product, whereby to seek to contain cooking by-product within the flow path.

2. The method of claim 1 wherein the volume rate of air exhausted is varied in proportion to at least the sensed level of cooking by-product.

3. The method of claim 1 wherein air is exhausted through the exhaust passage by a variable speed fan responsive to a control signal, the method further comprising:

generating the control signal correlated to at least the sensed level of cooking by-product whereby to vary the speed of the fan to vary the volume rate of air exhausted through the exhaust passage in accordance with at least the level of cooking by-product escaping from the flow path.

4. The method of claim 3 wherein the control signal is generated proportional to at least the level of sensed cooking by-product.

5. The method of claim 1 further comprising:

sensing heat load of the cooking unit; and further varying the volume rate at which air is exhausted through the exhaust passage in accordance with the heat load.

6. The method of claim 5 wherein sensing heat load includes measuring heat generated by the cooking unit.

7. The method of claim 5 wherein sensing heat load includes measuring temperature in the exhaust passage.

8. The method of claim 5 wherein sensing heat load includes measuring energy consumed by the cooking unit.

9. The method of claim 5 wherein air is exhausted through the exhaust passage by a variable speed fan responsive to a control signal, the method further comprising:

generating the control signal correlated to at least (1) the sensed level of cooking by-product whereby to vary the speed of the fan to vary the volume rate of air exhausted through the exhaust passage in accordance with the level of cooking by-product escaping from the flow path and (2) correlated to the heat load to further vary the speed of the fan to further vary the volume rate of air exhausted through the exhaust passage in accordance with the heat load.

10. The method of claim 9 wherein the control signal is generated proportional to at least the combined sensed level of cooking by-product and the heat load.

11. The method of claim 5 further comprising:

generating a first signal proportional to the level of cooking by-product escaping from the flow path;

generating a second signal proportional to the heat load;

generating a load signal which is a weighted sum of the first and second signals; and varying the volume rate of air which is exhausted in proportion to at least the load signal.

12. The method of claim 5 further comprising:

providing make-up air adjacent the hood; and controlling the rate of providing make-up air in accordance with the sensed level of cooking by-product and the heat load.

13. The method of claim 1 wherein sensing of cooking by-product escaping from the flow path is optical, the method further comprising:

launching a light beam along a path outside the flow path; and detecting a level of the launched light beam, wherein the detected level of the launched light beam corresponds to the level of cooking by-product escaping from the flow path.

14. The method of claim 1, the flow path being within the hood to define a zone between an edge of the hood and a periphery of the flow path, sensing of cooking by-product escaping from the flow path occurring in the zone.

15. The method of claim 14 wherein sensing of cooking by-product escaping from the flow path is optical, the method further comprising:

launching a light beam along a path in the zone; and detecting a level of the launched light beam, wherein the detected level of the launched light beam corresponds to the level of cooking by-product escaping from the flow path and into the zone.

16. The method of claim 15 further comprising providing a light beam source outside the hood and launching the light beam from outside the hood into the zone.

17. The method of claim 1 further comprising:

providing make-up air adjacent the hood; and controlling the rate of providing make-up air in accordance with the sensed level of cooking by-product.

18. The method of claim 1 wherein the volume rate of air exhausted is continuously varied in proportion to at least the sensed level of cooking by-product.

19. A method of controlling the volume rate of make-up air supplied in the vicinity of a hood positioned to collect heat and cooking by-product generated by a cooking unit and to exhaust same through an exhaust passage coupled to the hood, the method comprising:

exhausting collected heat and cooking by-product through the exhaust passage;

supplying a varying volume rate of make-up air through and in the vicinity of the hood;

sensing a level of cooking by-product generated by the cooking unit;

defining a flow path through the hood and between the cooking unit and the exhaust passage wherein sensing of the level of cooking by-product generated occurs outside the flow path; and varying the volume rate of make-up air supplied in accordance with at least the sensed level of cooking by-product.

20. The method of claim 19 wherein the volume rate of make-up air supplied is varied in proportion to the sensed level of cooking by-product.

21. The method of claim 19 further comprising sensing heat load of the cooking unit and further varying the volume rate of make-up air supplied in accordance with the heat load.

22. The method of claim 19 wherein the volume rate of air exhausted is continuously varied in proportion to at least the sensed level of cooking by-product.

23. An exhaust system for removing heat and cooking by-product generated by a cooking unit, comprising:

hood means for collecting heat and cooking by-products generated by the cooking unit;

exhaust port means coupled to the hood for exhausting, at a variable volume rate, air containing collected heat and cooking by-product;

air drive means for varying the volume rate of air exhausted by the exhaust port means to define a flow path through the hood means and between the cooking unit and the exhaust port means;

by-product sensor means situated relative the flow path for sensing a level of cooking by-product escaping from the flow path, the air drive means being responsive to the by-product sensor means for varying the volume rate of air exhausted whereby to seek to contain cooking by-product within the flow path.

24. The system of claim 23 further comprising:

heat load sensor means for sensing the heat load of the cooking unit, the air drive means further being responsive to the heat load sensor means for further varying the volume rate of air exhausted.

25. The system of claim 24, the heat lad sensor means including a temperature sensor situated above the cooking unit.

26. The system of claim 25, the temperature sensor being in the exhaust passage means.

27. The system of claim 24, the heat load sensor including:

energy sensor means for sensing energy consumed by the cooking unit.

28. The system of claim 24, the by-product sensor means generating a first signal proportional to the level of cooking by-product escaping from the flow path, the heat load sensor generating a second signal proportional to the heat load, the system further comprising:

summing means for generating a load signal which is a weighted sum of the first and second signals, the air drive means being responsive to the load signal.

29. The system of claim 24 further comprising:

make-up air means associated with the hood means for supplying make-up air in the vicinity of the hood means, the make-up air means being responsive to the by-product sensor means and the heat load sensor means whereby to vary the volume rate of make-up air supplied in accordance with the sensed level of cooking by-product and heat load.

30. The system of claim 23, the air drive means including a variable speed fan responsive to a control signal for varying the volume rate of air exhausted by the exhaust port means, the system further comprising:

control means responsive to the by-product sensor means for generating the control signal such that the control signal is correlated to the sensed level of cooking by-product.

31. The system of claim 23 further comprising:

make-up air means associated with the hood means for supplying make-up air in the vicinity of the hood means.

32. The system of claim 31, the make-up air means being responsive to the by-product sensor means whereby to vary the volume rate of make-up air supplied in accordance with the sensed level of cooking by-product.

33. The exhaust system of claim 23, the by-product sensor means including optical means for (a) launching a light beam along a path outside the flow path, and (b) detecting a level of the launched light beam, wherein the detected level of the launched light beam corresponds to the level of cooking by-product escaping from the flow path.

34. A make-up air exhaust system for removing heat and cooking by-products generated by a cooking unit, comprising:

hood means for collecting heat and cooking by-products generated by the cooking unit;

exhaust port means coupled to the hood for exhausting collected heat and cooking by-products;

make-up air supply means coupled through the hood for supplying a variable volume rate of air through and to the vicinity of the hood means;

by-product sensor means for sensing a level of cooking by-product generated by the cooking unit, the exhaust port means defining a flow path through the hood, the by-product sensor means positioned to sense the level of cooking by-product escaping from the flow path, the make-up air supply means being responsive to the by-product sensor means for varying the volume rate of air supplied.

35. The system of claim 34 further comprising heat load sensing means for sensing heat load of the cooking unit, the make-up air supply means further being responsive to the heat load sensing means for further varying the volume rate of air supplied.

36. A method of controlling the volume rate of air exhausted from a hood adjacent a cooking unit and through an exhaust passage coupled to the hood, the hood having a pair of spaced-apart, generally vertical, parallel walls with depending edges defining a generally planar exhaust opening therebetween, the hood positioned to collect through the exhaust opening heat and cooking by-product generated by the cooking unit, the method comprising:

causing cooking by-product generated by the cooking unit to pass through the exhaust opening;

launching a light beam along a path generally parallel the exhaust opening and extending between the walls;

detecting a level of the launched light beam wherein the detected level of the launched light beam corresponds to the level of cooking by-product passing through the exhaust opening; and varying the volume rate at which air is exhausted through the exhaust passage in accordance with at least the sensed level of cooking by-product passing through the exhaust opening.

37. The method of claim 36 further comprising:

sensing heat load of the cooking unit; and further varying the volume rate at which air is exhausted through the exhaust passage in accordance with the heat load.

38. An exhaust system for removing heat and cooking by-product generated by a cooking unit, comprising:

hood means having a pair of spaced-apart, generally vertical, parallel walls with depending edges defining a generally planar exhaust opening therebetween, the hood means for collecting through the exhaust opening heat and cooking by-product generated by the cooking unit;

exhaust port means coupled to the hood for exhausting, at a variable volume rate, air containing collected heat and cooking by-product whereby cooking by-product generated by the cooking unit will pass through the exhaust opening;

air drive means for varying the volume rate of air exhausted by the exhaust port means; and optical means for (a) launching a light beam along a path generally parallel the exhaust opening and extending between the hood walls, and (b) detecting a level of the launched light beam wherein the detected level of the launched light beam corresponds to the level of cooking by-product passing through the exhaust opening, the air drive means being responsive to the optical means for varying the volume rate of air exhausted.

39. The system of claim 38 further comprising:

heat load sensor means for sensing the heat load of the cooking unit, the air drive means further being responsive to the heat load sensor means for further varying the volume rate of air exhausted.

40. The system of claim 38, the optical means including a light source associated with one of the hood walls.

41. The system of claim 38, the optical means including a light detector associated with one of the hood walls.

42. The system of claim 38, the optical means including a light source associated with a first of the hood walls and a light detector associated with a second of the hood walls.

* * * * *

UNITED STATES PATENT AND TRADEMARK OFFICE

CERTIFICATE OF CORRECTION

PATENT NO. : 4,903,685

DATED : February 27, 1990

INVENTOR(S) : Stephen K. Melink

It is certified that error appears in the above-identified patent and that said Letters Patent is hereby corrected as shown below:

Col. 4, line 4, "s" should be -- is --.

Col. 11, line 52, "lad" should be -- load --.

Signed and Sealed this

Twentieth Day of August, 1991

*Attest:*

HARRY F. MANBECK, JR.

*Attesting Officer*

*Commissioner of Patents and Trademarks*